US010527960B1

(12) United States Patent
Wu

(10) Patent No.: US 10,527,960 B1
(45) Date of Patent: Jan. 7, 2020

(54) TETHERED METAL DIOXIDE FOR IMAGING MEMBERS

(71) Applicant: XEROX CORPORATION, Norwalk, CT (US)

(72) Inventor: Jin Wu, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/168,543

(22) Filed: Oct. 23, 2018

(51) Int. Cl.

| | |
|---|---|
| ***G03G 5/00*** | (2006.01) |
| ***G03G 5/153*** | (2006.01) |
| ***G03G 5/14*** | (2006.01) |
| ***G03G 5/147*** | (2006.01) |

(52) U.S. Cl.
CPC ..... *G03G 5/153* (2013.01); *G03G 5/142* (2013.01); *G03G 5/144* (2013.01); *G03G 5/14704* (2013.01); *G03G 5/14791* (2013.01)

(58) Field of Classification Search
CPC ..... G03G 5/144
USPC ..... 430/60
See application file for complete search history.

(56) References Cited

U.S. PATENT DOCUMENTS

2009/0297967 A1* 12/2009 Wu ..... G03G 5/0614 430/58.8

OTHER PUBLICATIONS

Wu, "Tethered Metal Dioxide for Imaging Members," U.S. Appl. No. 16/150,418, filed Oct. 3, 2018.

* cited by examiner

*Primary Examiner* — Mark A Chapman
(74) *Attorney, Agent, or Firm* — MH2 Technology Law Group LLP

(57) ABSTRACT

A photoreceptor comprises a conductive substrate. An undercoat layer is disposed on the conductive substrate. The undercoat layer includes modified metal oxide particles and a binder resin, the modified metal oxide particles comprising metal oxide particles having an outer surface and hygroscopic polymers attached to the surface. The hygroscopic polymers are made by linking a hydrophilic polymer group to the metal oxide particles using a dithiofunctionalized phosphonatomethylaryl ligand that acts as the linking group. A photosensitive layer is disposed on the undercoat layer.

20 Claims, 2 Drawing Sheets

TETHERED METAL DIOXIDE FOR IMAGING MEMBERS

DETAILED DESCRIPTION

Field of the Disclosure

This disclosure is generally directed to layered imaging members, photoreceptors and photoconductors.

BACKGROUND

Metal oxide-based undercoat layers are known for use in imaging members. Metal oxide containing undercoat layers provide the functions of blocking holes from metal substrate injection and unidirectional conduction of electrons from a charge generation layer to the metal substrate. The unidirectional conduction of electrons can be achieved by n-type semiconductors particles, such as certain metal oxides.

Metal oxides, such as titanium dioxide ($TiO_2$), can have lower than desired conductivity for undercoat layer applications. Further, it is known that the conductivity of $TiO_2$ can be humidity dependent, so that conductivity of the $TiO_2$ particles in potentially reduced in dry environments. Low conductivity of metal oxides can cause problems, such as ghosting, when the metal oxides are employed in the undercoat layer of an imaging member.

In an attempt to solve such problems, techniques for increasing conductivity of $TiO_2$ have been explored. For example, $TiO_2$ has been surface treated with sodium metaphosphate to enhance conductivity.

Novel methods for increasing the conductivity of metal oxide particles and/or enhancing conductivity of metal oxide particles in less humid environments would be a welcome addition to the art.

SUMMARY

An embodiment of the present disclosure is directed to a photoreceptor. The photoreceptor comprises a conductive substrate. An undercoat layer is disposed on the conductive substrate. The undercoat layer includes modified metal oxide particles and a binder resin, the modified metal oxide particles comprising metal oxide particles having an outer surface and hygroscopic polymers attached to the surface. The hygroscopic polymers are made by linking a hydrophilic polymer group to the metal oxide particles using a dithiofunctionalized phosphonatomethylaryl ligand that acts as the linking group. A photosensitive layer is disposed on the undercoat layer.

Another embodiment of the present disclosure is directed to a method of modifying an outer surface of a metal oxide particle. The method comprises: mixing the metal oxide particle with a compound having a phosphonatomethylaryl moiety functionalized with a dithioester group, wherein the phosphonatomethylaryl moiety attaches to the outer surface to form a dithioester functionalized phosphonatomethylaryl ligand; and linking a hydrophilic polymer group to the metal oxide particle using the dithiofunctionalized phosphonatomethylaryl ligand as a linking group to form a hygroscopic polymer.

Another embodiment of the present disclosure is directed to a modified metal oxide particle having an outer surface and hygroscopic polymer attached to the surface. The modified metal oxide particle is made by the method comprising: mixing a metal oxide particle having an outer surface with a compound having a phosphonatomethylaryl moiety functionalized with a dithioester group, wherein the phosphonatomethylaryl moiety attaches to the outer surface to form a dithioester functionalized phosphonatomethylaryl ligand; and linking a hydrophilic polymer group to the metal oxide particle using the dithiofunctionalized phosphonatomethylaryl ligand as a linking group to form the hygroscopic polymer.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrates embodiments of the present teachings and together with the description, serve to explain the principles of the present disclosure.

Figure 1:
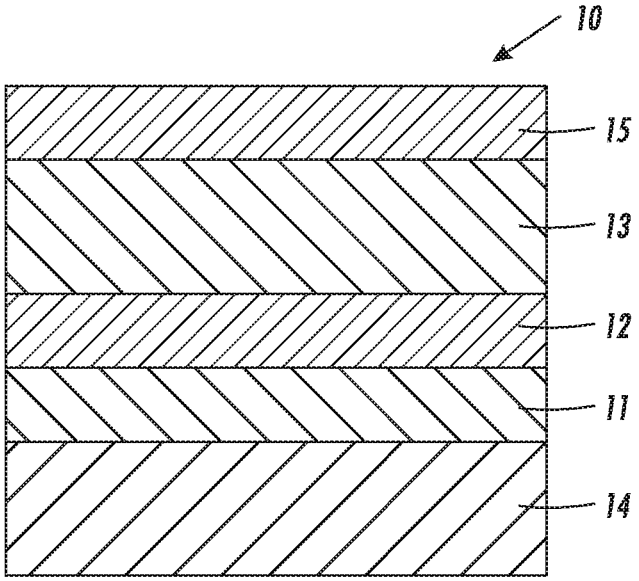
FIG. 1 is a schematic cross-sectional view of a photoreceptor layered structure, according to an embodiment of the present disclosure.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying figures. In the figures, like reference numerals have been used throughout to designate identical elements. In the following description, reference is made to the accompanying figures that forms a part thereof, and in which is shown by way of illustration a specific exemplary embodiment in which the present teachings may be practiced. The following description is, therefore, merely exemplary.

As used herein, the term, "electrostatographic," or grammatical versions thereof, is used interchangeably with the terms, "electrophotographic" and "xerographic". The terms, "charge blocking layer" and "blocking layer", are used interchangeably with the terms, "undercoat layer" or "undercoat" or grammatical versions thereof. "Photoreceptor" is used interchangeably with, "photoconductor", "imaging member" or "imaging component" or grammatical versions thereof.

In electrostatographic reproducing or imaging devices, including, for example, a digital copier, an image-on-image copier, a laser printer, a contact electrostatic printing device, a bookmarking device, a facsimile device, a printer, a multifunction device, a scanning device and any other such device, a printed output is provided, whether black and white or color, or a light image of an original is recorded in the form of an electrostatic latent image on an imaging device component, such as, a photoreceptor, which may be present as an integral component of an imaging device or as a replaceable component or module of an imaging device, and that latent image is rendered visible using electroscopic, finely divided, colored or pigmented particles, or toner. The imaging device component or photoreceptor can be used in electrostatographic (xerographic) imaging processes and devices, for example, as a flexible belt or in a rigid drum configuration. Other components may include a flexible intermediate image transfer belt, which can be seamless or seamed.

In electrostatographic image formation, a photoreceptor is charged and then exposed to light for formation of an electrostatic latent image. The exposure of the photoreceptor to light causes the attenuation of the surface potential thereof; in this process, electric charges move at the interface between the photosensitive layer (for example, a charge-generating layer in a functionally-separated photosensitive layer) and the undercoat layer. In the undercoat layer electric charges are transferred.

Figure 2:
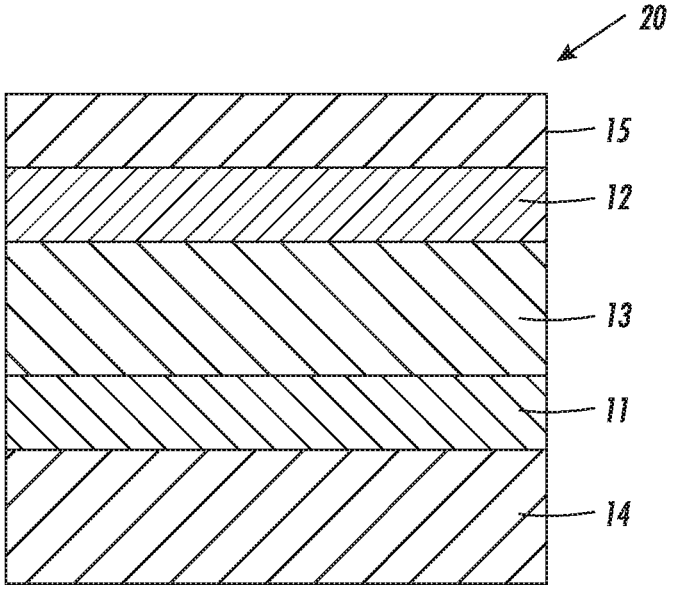
FIG. 2 is a schematic cross-sectional view of a photoreceptor layered structure, according to an embodiment of the present disclosure.
Figure 3:
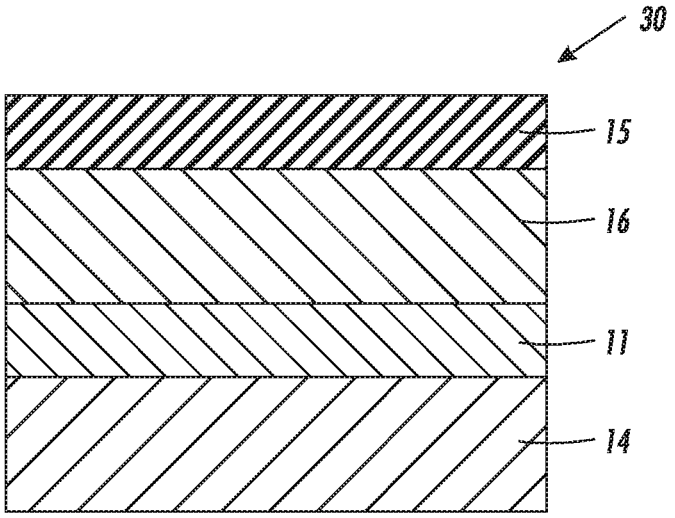
FIG. 3 is a schematic cross-sectional view of a photoreceptor layered structure, according to an embodiment of the present disclosure.

FIG. 1 is a schematic cross-sectional view illustrating an embodiment of a photoreceptor. FIGS. 2 and 3 are schematic cross-sectional views illustrating alternative embodiments of photoreceptors.

A photoreceptor 10 illustrated in FIG. 1 is a functionally-separated photoreceptor (layered photoreceptor) and includes a conductive substrate 14; an undercoat layer 11 formed thereon; a charge generation layer 12; charge transport layer 13; and an overcoat layer 15. The layers disclosed are disposed in sequence so as to overlie the conductive substrate 14 and the undercoat layer 11. In the photoreceptor 10 of FIG. 1, the charge generation layer 12 and the charge transport layer 13 constitute a photosensitive layer.

A photoreceptor 20 illustrated in FIG. 2 is a functionally-separated photoreceptor in which the charge generation layer 12 and the charge transport layer 13 are functionally separated as in the photoreceptor 10 illustrated in FIG. 1. The photoreceptor 20 illustrated in FIG. 2 includes the conductive substrate 14 and the undercoat layer 11 formed thereon. The charge transport layer 13, charge generation layer 12, and overcoat layer 15 are disposed in sequence so as to overlie the conductive substrate 14 and the undercoat layer 11. In the photoreceptor 20, the charge transport layer 13 and the charge generation layer 12 constitute a photosensitive layer. The charge transport layer 13 and the charge generation layer 12 in FIG. 2 are reversed from the sequence shown in FIG. 1.

A photoreceptor 30 is illustrated in FIG. 3. The photoreceptor 30 in FIG. 3 includes a charge generating material and a charge transporting material in a single layer (photosensitive layer 16). The photoreceptor 30 includes the conductive substrate 14, the undercoat layer 11 formed thereon, and the single photosensitive layer 16 disposed so as to overlie the conductive substrate 14 and the undercoat layer 11. An overcoat layer 15 overlies the photosensitive layer 16.

Each layer of the photoreceptor 10 illustrated in FIG. 1, the photoreceptor 20 in FIG. 2 and the photoreceptor 30 in FIG. 3 are described below.

Conductive Substrate (14)

Examples of the conductive substrate 14 include metal plates, metal drums, and belts comprising metals (such as aluminum, copper, zinc, chromium, nickel, molybdenum, vanadium, indium, gold, and platinum) or alloys (such as stainless steel). Other examples of the conductive substrate include paper, resin films, and belts each having a coating film formed by applying, depositing, or laminating conductive compounds (such as conductive polymers and indium oxide), metals (such as aluminum, palladium, gold and alloys thereof). The term "conductive" herein refers to having a volume resistivity that is less than $10^{13}$ Ωcm.

The conductive substrate 14 may be flexible or rigid and may have any of a number of different configurations, such as, for example, a sheet, a scroll, an endless flexible belt, a web, a cylinder, and the like.

The thickness of the conductive substrate depends on numerous factors, including the desired mechanical performance and economic considerations. The thickness of the conductive substrate 14 is typically within a range of from about 65 micrometers to about 150 micrometers, such as from about 75 micrometers to about 125 micrometers for optimum flexibility and minimum induced surface bending stress when cycled around small diameter rollers, e.g., 19 mm diameter rollers. The conductive substrate 14 as a flexible belt may be of substantial thickness, for example, over 200 micrometers, or of minimum thickness, for example, less than 50 micrometers, provided there are no adverse effects on the final photoconductive device. Where a drum is used, the thickness can be sufficient to provide the desired rigidity. This can be, for example, about 1-6 mm.

The surface of the conductive substrate 14 to which other layers may be applied may be cleaned to promote greater adhesion of such layers. Cleaning may be effected, for example, by exposing the surface of the substrate layer to plasma discharge, ion bombardment, and the like. Other methods, such as solvent cleaning, may also be used.

Charge Generation Layer (12)

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments such as benzimidazole perylene; indigo pigments such as indigo, thioindigo, and the like; bisbenzoimidazole pigments such as Indofast Orange, and the like; phthalocyanine pigments such as copper phthalocyanine, aluminochloro-phthalocyanine, hydroxygallium phthalocyanine, chlorogallium phthalocyanine, titanyl phthalocyanine and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. In embodiments, alloys of selenium may be used and include for instance selenium-arsenic, selenium-tellurium-arsenic, and selenium-tellurium.

Any suitable inactive resin binder material may be employed in the charge generating layer 12. Typical organic resinous binders include polycarbonates, acrylate polymers, methacrylate polymers, vinyl polymers, cellulose polymers, polyesters, polysiloxanes, polyamides, polyurethanes, epoxies, polyvinyl acetals, and the like.

To create a dispersion useful as a coating composition, a solvent is used with the charge generating material. The solvent may be for example cyclohexanone, methyl ethyl ketone, tetrahydrofuran, alkyl acetate, and mixtures thereof. The alkyl acetate (such as butyl acetate and amyl acetate) can have from 3 to 5 carbon atoms in the alkyl group. The amount of solvent in the composition ranges for example from about 70% to about 98% by weight, based on the weight of the composition.

The amount of the charge generating material in the composition ranges for example from about 0.5% to about 30% by weight, based on the total weight of the composition including a solvent. The amount of photoconductive particles (i.e., the charge generating material) dispersed in a dried photoconductive coating varies to some extent with the specific photoconductive pigment particles selected. For example, when phthalocyanine organic pigments such as titanyl phthalocyanine and metal-free phthalocyanine are utilized, satisfactory results are achieved when the dried photoconductive coating comprises between about 30 percent by weight and about 90 percent by weight of all phthalocyanine pigments based on the total weight of the dried photoconductive coating. Because the photoconductive characteristics are affected by the relative amount of pigment per square centimeter, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. The average photoconductive particle size may be less than about 0.4 micrometer. In embodiments, the photoconductive particle size is also less than the thickness of the dried photoconductive coating in which it is dispersed.

In charge generation layer 12, the weight ratio of the charge generating material ("CGM") to the binder ranges, for example, from about 30 (CGM):70 (binder) to about 70 (CGM):30 (binder).

The charge generation layer 12 can have any suitable thickness that allows it to function effectively as a charge generating layer. An example of suitable thicknesses range from about 0.1 micrometer to about 50 micrometers, such as about 0.1 micrometer to about 10 micrometers, or about 0.2 micrometer and about 4 micrometers. However, these thicknesses also depend upon the pigment loading. Thus, higher pigment loadings permit the use of a thinner charge generation layer. Thicknesses outside these ranges may be selected providing the objectives of the present invention are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

Charge Transport Layer (13)

Charge transport materials can include an organic polymer, a non-polymeric material, or a structured organic film (SOF), which may be a composite and/or capped SOF, capable of supporting the injection of photoexcited holes or transporting electrons from the photoconductive material and allowing the transport of these holes or electrons through the organic layer to selectively dissipate a surface charge. Additional examples of charge transport materials include a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methylpyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene) and poly(vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile, see U.S. Pat. No. 4,921,769 the disclosure of which is incorporated herein by reference in its entirety. Other hole transporting materials include arylamines described in U.S. Pat. No. 4,265,990 the disclosure of which is incorporated herein by reference in its entirety, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like. Other known charge transport layer molecules may be selected, such as those described in U.S. Pat. Nos. 4,921,773 and 4,464,450, the disclosures of which are incorporated herein by reference in their entireties.

Any suitable technique may be utilized to apply the charge transport layer 13 and the charge generating layer 12 to the substrate 14. Typical coating techniques include dip coating, roll coating, spray coating, rotary atomizers, and the like. The coating techniques may use a wide concentration of solids. The solids content can be between, for example, about 2 percent by weight and 30 percent by weight based on the total weight of the dispersion. The expression "solids" refers, for example, to the charge transport particles and binder components of the charge transport coating dispersion. These solids concentrations are useful in dip coating, roll, spray coating, and the like. Generally, a more concentrated coating dispersion may be used for roll coating. Drying of the deposited coating may be effected by any suitable conventional technique such as oven drying, infrared radiation drying, air drying and the like. Generally, the thickness of the charge transport layer 13 is between about 5 micrometers to about 100 micrometers, but thicknesses outside these ranges can also be used. In general, the ratio of the thickness of the charge transport layer to the charge generating layer is maintained, for example, from about 2:1 to 200:1 and in some instances as great as about 400:1.

Single Photosensitive Layer (16)

A photosensitive layer 16 (charge-generating/charge-transporting layer, embodied in FIG. 3) is, for example, a layer containing a charge-generating material, a charge-transporting material, and optionally a binder resin and another known additive. These materials can be, for example, the same as those materials used for forming the charge-generating layer and the charge-transporting layer.

The amount of the charge-generating material contained in the single photosensitive layer is suitably from about 10 weight % to about 85 weight %, and preferably from about 20 weight % to about 50 weight % relative to the total solid content. The amount of the charge-transporting material contained in the single photosensitive layer is suitably from about 5 weight % to about 50 weight % relative to the total solid content.

The photosensitive layer 16 can be formed by the same techniques as those for forming the charge generation layer 12 and the charge transport layer 13.

The thickness of the single photosensitive layer 16 is, for instance, suitably from 5 microns to 50 microns, or in embodiments from 10 microns to 40 microns.

Overcoat Layer (15)

An overcoat layer 15 is optionally formed on the photosensitive layer. The overcoat layer 15 is formed, for instance, in order to prevent the photosensitive layer from being chemically changed in the charging and to improve the mechanical strength of the photosensitive layer. In an embodiment, the overcoat layer is a cured film (crosslinked film).

In embodiments, the overcoat layer 15 may have a thickness ranging from about 1 micron to about 25 microns or from about 1 micron to about 10 microns, or in a specific embodiment, about 3 microns to about 10 microns. The overcoat layer may include a charge transport component and an optional organic polymer or inorganic polymer. The overcoat layer may include thermoplastic organic polymers or cross-linked polymers such as thermosetting resins, UV or e-beam cured resins, and the like.

The overcoat layer 15 may further include a particulate additive such as metal oxides including aluminum oxide and silica, or low surface energy polytetrafluoroethylene (PTFE), and combinations thereof. Any known or new overcoat materials may be included for the present embodiments. In embodiments, the overcoat layer may include a charge transport component or a cross-linked charge transport component. In particular embodiments, for example, the overcoat layer comprises a charge transport component comprised of a tertiary arylamine containing substituent capable of self cross-linking or reacting with the polymer resin to form a cured composition.

In embodiments, the overcoat layer may comprise structured organic films (SOFs) that are electrically insulating or slightly semi-conductive. Such an overcoat includes a structured organic film forming reaction mixture containing a plurality of molecular building blocks that optionally contain charge transport segments as described in U.S. Pat. No. 8,372,566 incorporated by reference in its entirety.

Additives may be present in the overcoat layer 15 in the range of about 0.5 to about 40 weight percent of the overcoat layer 15. In embodiments, additives include organic and inorganic particles, which can further improve the wear resistance and/or provide charge relaxation property. In embodiments, organic particles include Teflon powder, carbon black, and graphite particles. In embodiments, inorganic particles include insulating and semiconducting metal oxide particles such as silica, zinc oxide, tin oxide and the like. Other semiconducting additives include the oxidized oligomer salts as described in U.S. Pat. No. 5,853,906, the disclosure of which is incorporated herein by reference in its entirety. In embodiments, oligomer salts include oxidized N,N,N',N'-tetra-p-tolyl-4,4'-biphenyldiamine salt.

Undercoat Layer (11)

The undercoat layer 11 prevents hole injection from the conductive substrate 14 and conducts electrons from the charge generation layer 12 to the conductive substrate 14. The undercoat layer 11 may be positioned directly on or over the electrically conductive substrate 14. The term "over," as used herein in connection with many different types of layers, should be understood as not being limited to instances wherein the layers are contiguous. Rather, the term "on" or "over" refers, for example, to the relative placement of the layers and encompasses the inclusion of unspecified intermediate layers. Thus, the term "on" or "over" encompasses, but is not limited to, instances of direct physical contact; and it is contemplated that all occurrences of the terms "on" or "over" in the present disclosure can be replaced with the phrase "directly on" to indicate direct physical contact.

It is known that the conductivity of metal oxides is humidity dependent with higher conductivity in more humid environment due to more moisture adsorption onto its surface. However, the ability of adsorbing moisture from less humid environment can be limited. By chemical attachment of a hygroscopic polymeric moiety onto a metal oxide surface, significantly enhanced conductivity in less humid environments can be achieved. The attached hygroscopic polymeric chains described herein adsorb more moisture onto the metal oxide surface from the environment than metal oxide particles having an unmodified metal oxide surface. Furthermore, the attached polymeric chains can significantly enhance metal oxide dispersibility in polymeric films.

The undercoat layer 11 disclosed herein includes modified metal oxide particles having a hygroscopic polymer attached to the particle outer surface and a binder resin. The binder resin can be a polyamide resin, a nylon resin, for example, copolymer nylon polymerized with 6-nylon, 6,6-nylon, 610-nylon, 11-nylon, 12-nylon and the like; and nylon which is chemically denatured such as N-alkoxy methyl denatured nylon and N-alkoxy ethyl denatured nylon. Another type of binder resin that may be used is a phenolic resin or polyvinyl butyral resin. A single resin or combinations of two or more of any of the above binder resins can be employed.

The modified metal oxide particles having hygroscopic polymers attached thereto are from about 5 weight percent to about 90 weight percent, such as about 10 weight percent to about 80 weight percent, or about 30 weight percent to about 70 weight percent, relative to the total weight of solids in the undercoat layer 11.

The undercoat layer 11 may have any suitable thickness. For example, the thickness can range from about 0.01 micrometer to about 40 micrometers, such as from about 1 micrometer to about 30 micrometers, or about 1 micrometer to about 20 micrometers.

The undercoat layer 11 is formed by dispersing the binder resin and modified metal oxide particles in a solvent to form a coating solution. The conductive substrate 14 is coated with the coating solution and dried to form the undercoat layer 11.

The solvent may be an azeotropic mixture of one or more $C_{1-4}$ lower alcohols and at least one organic solvent selected from the group consisting of dichloromethane, chloroform, 1,2-dichloroethane, 1,2-dichloropropane, toluene, xylene, methyl ethyl ketone and tetrahydrofuran. The azeotropic mixture mentioned above is a solution in which a composition of the liquid phase and a composition of the vapor phase coincide with each other at a certain pressure to give a mixture having a constant boiling point. For example, a mixture comprised of 35 parts by weight of methanol and 65 parts by weight of 1,2-dichloroethane is an azeotropic solution, as is a mixture comprised of 50 parts by weight of 1-butanol and 50 parts by weight of xylene.

The metal oxide particles can be tin oxide particles, titanium oxide particles, zinc oxide particles, aluminum oxide particles, and zirconium oxide particles. The particles can be nanoscopic in size. For example, the average primary particle size of the metal oxide particles can be about 500 nanometers or less; or in embodiments in the range of about 10 nanometers to about 500 nanometers, such as about 20 nanometers to about 200 nanometers, or about 30 nanometers to about 150 nanometers, or about 30 nanometers to about 100 nanometers.

The hygroscopic polymers are made by linking a hydrophilic polymer group to the metal oxide particles. To achieve this linking process, the metal oxide particles are first modified to include a dithiofunctionalized phosphonatomethylaryl ligand that acts as the linking group. In an embodiment, the hydrophilic polymer group is attached to the linking group by polymerization of hydrophilic monomers in the presence of the dithioester functionalized phosphonatomethylaryl ligand attached to the metal oxide particles. The resulting hydrophilic polymer group can be a hydrophilic polymer chain of any desired sequence length that can be formed by the polymerization reaction. Alternatively, it may be possible for the hydrophilic polymers to be formed to a desired length and then grafted onto the dithioester functionalized phosphonatomethylaryl ligand.

The dithioester functionalized phosphonatomethylaryl ligands are attached to the outer surface of the metal oxide particles by mixing the metal oxide particles in a solvent with a compound having a phosphonatomethylaryl moiety functionalized with a dithioester group. The solvent can be any of the solvents listed herein, such as tetrahydrofuran. As is known in the art, the phosphonatomethylaryl moiety has a strong affinity to metal oxide particles due to ionic interaction. Thus, when mixed together, the dithioester functionalized phosphonatomethylaryl compounds are attached to the metal oxide surface of the particles by ionic bonding with the phosphonatomethylaryl moieties. The dithioester groups on the resulting ligand serve as a chain transfer point to add hydrophilic polymer groups onto the metal oxide surface.

As stated above, the hydrophilic polymer group can be grafted onto the dithioester functionalized phosphonatomethylaryl ligand. The grafted polymer group can be any suitable hydrophilic polymer, including polymers made from any of the hydrophilic monomers described herein. Alternatively, the hydrophilic polymer group can be formed by polymerization of hydrophilic monomers in the presence of the dithioester functionalized phosphonatomethylaryl ligand. The polymerization of the hydrophilic monomers with the dithioester functionalized phosphonatomethylaryl ligand can be initiated with a thermal initiator. The polymerization proceeds by a reversible addition/fragmentation chain-transfer ("RAFT") polymerization route of the hydrophilic monomers in the presence of the dithioester-functionalized metal oxide particles. RAFT polymerization is generally well known in the art. The degree of polymerization of the attached hydrophilic polymer group can be any desired amount, such as, for example, from about 2 to about 2,000, or from about 20 to about 1,000, or from about 100 to about 500.

Any suitable compound having a phosphonatomethylaryl moiety functionalized with a dithioester group can be employed to form the dithioester functionalized phosphonatomethylaryl ligands of the present disclosure. Examples of such compounds are shown below:

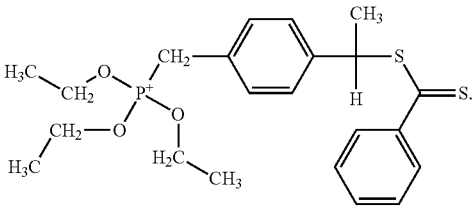

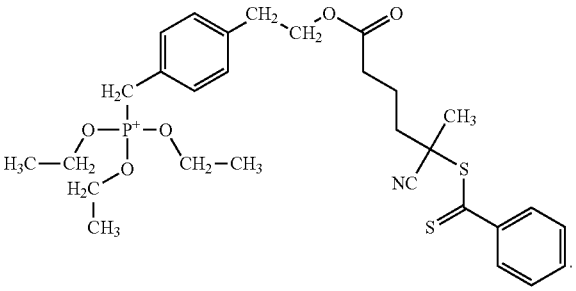

A single compound or mixtures of two or more of any of the above compounds having a phosphonatomethylaryl moiety functionalized with a dithioester group, as described herein, can be employed. One of ordinary skill in the art would readily be able to synthesize the above compounds having a phosphonatomethylaryl moiety functionalized with a dithioester group using known techniques.

Any thermal initiators suitable for RAFT polymerization with dithioester functionalized phosphonatomethylaryl ligands can be employed to initiate the hydrophilic monomer polymerization. Examples of thermal initiators include peroxide compounds such as benzoyl peroxide, tert-amyl peroxybenzoate, 2,2-bis(tert-butylperoxy)butane, 1,1-bis(tert-butylperoxy)cyclohexane, 2,5-bis(tert-butylperoxy)-2,5-dimethylhexane, 2,5-bis(tert-butylperoxy)-2,5-dimethyl-3-hexyne, bis(1-(tert-butylperoxy)-1-methylethyl)benzene, 1,1-bis(tert-butylperoxy)-3,3,5-trimethylcyclohexane, tert-butyl hydroperoxide, tert-butyl peroxide, tert-butyl peroxybenzoate, tert-butylperoxy isopropyl carbonate, cumene hydroperoxide, cyclohexanone peroxide, dicumyl peroxide, lauroyl peroxide, and 2,4-pentanedione peroxide; azo compounds such as 2,2'-azobisisobutyronitrile, 4,4-azobis(4-cyanovaleric acid), and 1,1'-Azobis(cyclohexanecarbonitrile); and other compounds such as tert-butyl peracetate, peracetic acid, and potassium persulfate; and the like. A single thermal initiator or a mixture of two or more of any of the thermal initiators described herein can be employed.

Hydrophilic monomers that can be used to form the hygroscopic polymer on the outer surface of the metal oxide particle include any hydrophillic monomers suitable for forming a hydrophilic group by a RAFT polymerization process. In an embodiment, the hydrophilic monomers are monomers that have one or more vinyl end groups attached to a hydrophilic moiety. Examples of such monomers include methacrylamide, 2-acrylamido-2-methyl-1-propanesulfonic acid, 3-(acrylamido)phenylboronic acid, N-hydroxyethyl acrylamide, (4-hydroxyphenyl)methacrylamide, acrylic acid, 6-O-acryloyl-1,2:3,4-bis-O-(1-methylethylidene)-α-D-galactopyranose, poly(ethoxy (10) ethyl methacrylate), N, N-dimethylacrylamide, methacrylic acid, Beta-carboxyethyl acrylate, 2-cyanoethyl acrylate, ethylene glycol dimethacrylate, hydroxypoly(ethoxy (10) allyl ether), sodium 1-allyloxy-2 hydroxypropyl sulfonate, allyl phenyl ether, diallyl maleate, 4-vinylphenol and the like and mixtures thereof. The hydrophilic monomers are represented by the following formulae, respectively:

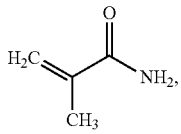

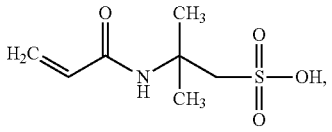

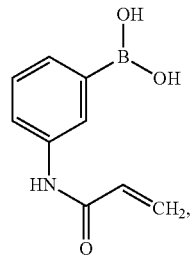

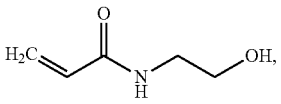

-continued

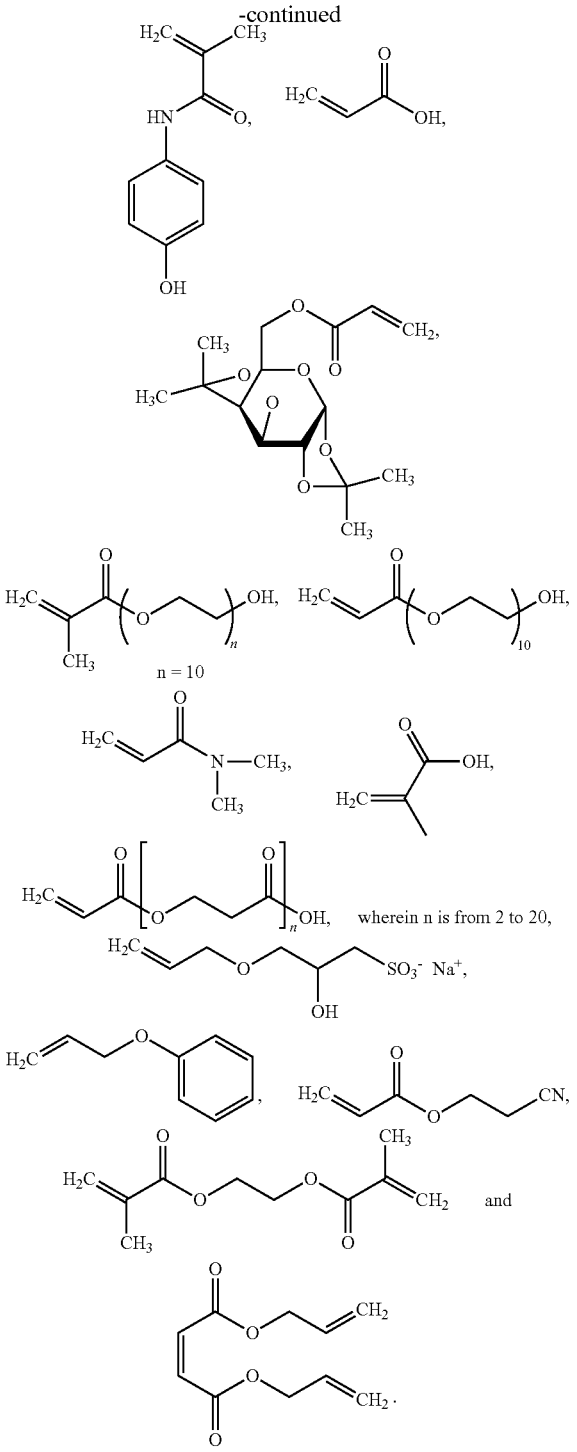

A single hydrophilic monomer or a mixture of two or more of any of the hydrophilic monomers described herein can be employed.

Although not illustrated, optional layers may be provided in the photoreceptors shown in FIGS. 1-3. Example of optional layers include an intermediate layer, an adhesive layer or an anti-curl back coating layer.

Intermediate Layer

The intermediate layer can optionally be formed between any two or more of the conductive substrate 14, undercoat layer 11, charge generation layer 12, charge transport layer 13 and overcoat layer 15. Examples of the resin used for forming the intermediate layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organic metal compound. Examples of the organic metal compound used for forming the intermediate layer include organic metal compounds containing metal atoms of zirconium, titanium, aluminum, manganese, or silicon.

The compounds used for forming the intermediate layer may be used alone or in the form of a mixture or polycondensate of multiple compounds. In particular, the intermediate layer is suitably a layer containing an organic metal compound that contains a zirconium atom or a silicon atom.

Adhesive Layer

An optional adhesive interface layer may be employed. An adhesive layer may be situated, for example, intermediate between the undercoat layer 11 and the charge generation layer 12. The adhesive layer may include a film-forming material, such as, a polyurethane, a polyester and so on. An example of a polyester includes a polyarylate, a polyvinyl butyral and the like.

Any suitable solvent or solvent mixture may be employed to form an adhesive layer coating solution. Typical solvents include tetrahydrofuran, toluene, monochlorobenzene, methylene chloride, cyclohexanone and the like, as well as mixtures thereof. Any suitable and conventional technique may be used to mix and thereafter to apply the adhesive interface layer coating mixture to the photoreceptor under construction as taught herein or as known in the art. Typical application techniques include spraying, dip coating, roll coating, wire wound rod coating and the like. Drying of the deposited wet coating may be accomplished by any suitable conventional process, such as oven drying, infrared drying, air drying and the like.

The adhesive layer may have a thickness of from about 0.01 micrometer to about 900 micrometers after drying. In certain embodiments, the dried thickness is from about 0.03 micrometer to about 1 micrometer.

Anti-Curl Back Coating Layer

An anti-curl back coating may be applied to the surface of a substrate opposite to that bearing the photoconductive layer(s) to provide flatness and/or abrasion resistance, such as, when a web configuration imaging device component is contemplated. The anti-curl back coating layer is known and can comprise a film-forming material or binder, such as, thermoplastic organic polymers or inorganic polymers. Such polymers are electrically insulating or slightly semi-conductive. The thickness of anti-curl back coating layers generally is sufficient to balance substantially the total forces of the layer or layers on the opposite side of a substrate. An example of an anti-curl back coating layer is described in U.S. Pat. No. 4,654,284, the disclosure of which is incorporated herein by reference in its entirety. A thickness of from about 70 μm to about 160 μm can be used for a flexible device imaging component, although the thickness can be outside that range as a design choice.

Because conventional anti-curl back coating formulations can suffer from electrostatic charge build up due to contact friction between the anti-curl back coating layer and, for example, backer bars, which can increase friction and wear, incorporation of compounds to dissipate charge, such as, nanopolymeric gel particles, into the anti-curl back coating layer can substantially eliminate charge build up. In addition to reducing electrostatic charge build up and reducing wear in the layer, a charge dissipating material, such as, nanopolymeric gel particles, may be used to enhance lubricity, scratch resistance and wear resistance of the anti-curl back coating layer. In some embodiments, the nanopolymeric gel particles are comprised of crosslinked polystyrene-n-butyl acrylate, which are dispersed or embedded in a film-forming material or binder, such as, a polymer or a matrix.

In some embodiments, the anti-curl back coating layer may comprise a charge transport molecule or component. The charge transport molecule may be present from about 1% to about 60% by weight of the total weight of the anti-curl back coating layer.

Various aspects of the embodiments of interest now will be exemplified in the following non-limiting examples. While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature(s) may be combined with one or more other features of the other implementations as may be desired and advantageous for any given or particular function.

EXAMPLES

Prophetic Example 1

Fifty grams of titanium dioxide ($TiO_2$) STR-60N (from Sakai Chemical Industry Co. Ltd.) are mixed with 200 grams of tetrahydrofuran with constant strong agitation. Five grams of a compound having the following structure are added and allowed to mix for 1 hour.

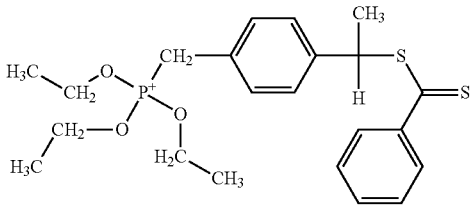

Ten grams of acrylic acid and two grams of 2,2'-azobisisobutyronitrile are then added, and the mixture is heated up to about 60° C. The free radical polymerization is allowed to take place for 4 hours at this temperature with constant strong agitation. The treated $TiO_2$ is then separated from the rest of the mixture through filtration, and washed with THF three times. The resulting poly(acrylic acid) attached $TiO_2$ is dried at 80° C. under vacuum overnight.

Prophetic Example 2

Fifty grams of titanium dioxide ($TiO_2$) STR-60N (from Sakai Chemical Industry Co. Ltd.) are mixed with 200 grams of tetrahydrofuran with constant strong agitation. Five grams of a phosphonatomethylaryl moiety having the following structure are added and allowed to mix for 1 hour.

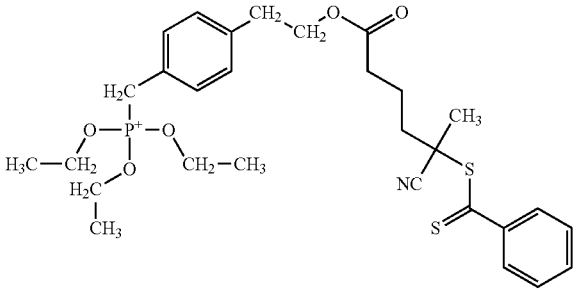

Ten grams of N-hydroxyethyl acrylamide and two grams of 2,2'-azobisisobutyronitrile are then added, and the mixture is heated up to about 60° C. The free radical polymerization is allowed to take place for 4 hours at this temperature with constant strong agitation. The treated $TiO_2$ is then separated from the rest of the mixture through filtration, and washed with THF three times. The resulting poly(N-hydroxyethyl acrylamide) attached $TiO_2$ is dried at 80° C. under vacuum overnight.

Prophetic Example 3

The imaging member is fabricated comprising a 30-millimeter diameter mirror aluminum substrate, an undercoating layer having $TiO_2$ of Prophetic Example 1, a charge generating layer, and a charge transport layer.

The undercoat layer is fabricated from a coating dispersion consisting of $TiO_2$ of Prophetic Example 1 and phenolic resin (Varcum 29159, OxyChem) in xylene/1-butanol (wt/wt=50/50). The weight ratio of titanium dioxide and phenolic resin is 60/40. An aluminum drum substrate of 30 millimeters in diameter is coated with the undercoat layer coating dispersion and dried at a temperature of 145° C. for 45 minutes. The resulting undercoat layer has a thickness of about 4.0 micrometers.

The charge generating layer coating dispersion is prepared by dispersing 15 grams of hydroxygallium phthalocyanine (V) particles in a solution of 10 grams of VMCH, a terpolymer of vinyl alcohol, vinyl acetate and maleic acid from Dow Chemical, in 368 grams of n-butyl acetate. This dispersion is milled in an ATTRITOR with 1 mm glass beads for 3 hours. The drum with the undercoat layer then is coated with the charge generating layer coating dispersion. The resulting coated drum is air dried to form a 0.2~0.5-micrometer thick charge generating layer.

A charge transport layer is coated using a solution of a mixture of 60 weight % of PCZ400 (a polycarbonate Z, available from Mitsubishi Gas Chemical Company, Inc.), and 40 weight % of charge transport molecule N,N'-diphenyl-N,N'-bis(3-methylphenyl)-[1,1'-biphenyl]-4,4'-diamine. The solution is in 70:30 by weight ratio of tetrahydrofuran: toluene solvent mixture, providing an approximate solids content of 23 33% by weight. The charge transport layer is dried at 120° C. for 40 minutes. The dried charge transporting layer thickness is about 24 microns.

Prophetic Example 4

An imaging member is fabricated similarly to the Prophetic Example 3 imaging member except that $TiO_2$ of Prophetic Example 1 is replaced with $TiO_2$ of Prophetic Example 2.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising". Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompasses by the following claims.

What is claimed is:

1. A photoreceptor comprising:

a conductive substrate;

an undercoat layer disposed on the conductive substrate, the undercoat layer including modified metal oxide particles and a binder resin, the modified metal oxide particles comprising metal oxide particles having an outer surface and hygroscopic polymers attached to the surface, wherein the hygroscopic polymers are made by linking a hydrophilic polymer group to the metal oxide particles using a dithiofunctionalized phosphonatomethylaryl ligand that acts as the linking group; and a photosensitive layer disposed on the undercoat layer.

2. The photoreceptor according to claim 1, wherein the metal oxide particles are selected from the group consisting of: tin oxide particles, titanium oxide particles, zinc oxide particles, aluminum oxide particles, zirconium oxide particles and mixtures thereof.

3. The photoreceptor according to claim 1, wherein the hydrophilic polymer group is formed by a polymerization of one or more hydrophilic monomers.

4. The photoreceptor according to claim 3, wherein, the hydrophilic monomers are selected from the group consisting of: methacrylamide, 2-acrylamido-2-methyl-1-propanesulfonic acid, 3-(acrylamido)phenylboronic acid, N-hydroxyethyl acrylamide, (4-hydroxyphenyl)methacrylamide, acrylic acid, 6-O-acryloyl-1,2:3,4-bis-O-(1-methylethylidene)-α-D-galactopyranose, poly(ethoxy (10) ethyl methacrylate), hydroxypoly(ethoxy (10) allyl ether), N, N-dimethylacrylamide, methacrylic acid, Beta-carboxyethyl acrylate, sodium 1-allyloxy-2 hydroxypropyl sulfonate, allyl phenyl ether, 2-cyanoethyl acrylate, ethylene glycol dimethacrylate, diallyl maleate and 4-vinylphenol and mixtures thereof.

5. The photoreceptor according to claim 1, further comprising an overcoat layer disposed on the photosensitive layer.

6. The photoreceptor according to claim 1, wherein the modified metal oxide particles are in an amount ranging from about 5 weight percent to about 90 weight percent, relative to the total weight of solids in the undercoat layer.

7. The photoreceptor according to claim 1, wherein the photosensitive layer comprises a charge generation layer and a charge transport layer that is separate from the charge generation layer.

8. The photoreceptor according to claim 1, wherein the dithioester functionalized phosphonatomethylaryl ligand is attached to the metal oxide particle by mixing the metal oxide particle with a compound having a phosphonatomethylaryl moiety functionalized with a dithioester group, the compound having a structure selected from the group consisting of:

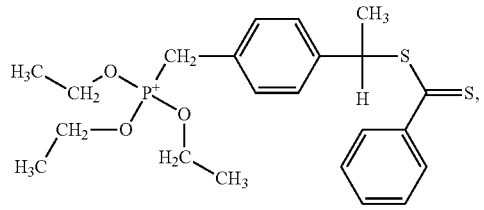

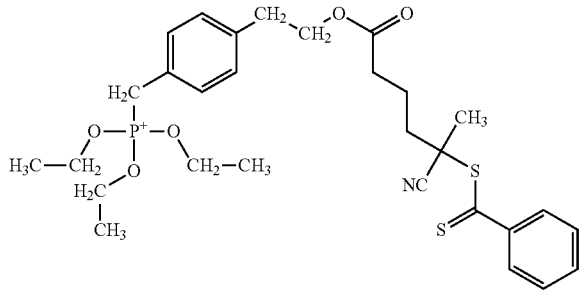

and mixtures thereof.

9. The photoreceptor according to claim 1, wherein a degree of polymerization of the hydrophilic polymer group is from about 2 to about 2,000.

10. A method of modifying an outer surface of a metal oxide particle comprising:

mixing the metal oxide particle with a compound having a phosphonatomethylaryl moiety functionalized with a dithioester group, wherein the phosphonatomethylaryl moiety attaches to the outer surface to form a dithioester functionalized phosphonatomethylaryl ligand; and linking a hydrophilic polymer group to the metal oxide particle using the dithiofunctionalized phosphonatomethylaryl ligand as a linking group to form a hygroscopic polymer.

11. The method according to claim 10, wherein the hydrophilic polymer group is formed by polymerizing one or more hydrophilic monomers in the presence of the dithioester functionalized phosphonatomethylaryl ligand.

12. The method according to claim 11, wherein the hydrophilic monomers are selected from the group consisting of methacrylamide, 2-acrylamido-2-methyl-1-propanesulfonic acid, 3-(acrylamido)phenylboronic acid, N-hydroxyethyl acrylamide, (4-hydroxyphenyl)methacrylamide, acrylic acid, 6-O-acryloyl-1,2:3,4-bis-O-(1-methylethylidene)-α-D-galactopyranose, poly(ethoxy (10) ethyl methacrylate), hydroxypoly(ethoxy (10) allyl ether), N, N-dimethylacrylamide, methacrylic acid, Beta-carboxyethyl acrylate, sodium 1-allyloxy-2 hydroxypropyl sulfonate, allyl phenyl ether, 2-cyanoethyl acrylate, ethylene glycol dimethacrylate, diallyl maleate and 4-vinylphenol and mixtures thereof.

13. The method according to claim 10, wherein the linking of the hydrophilic polymer group is carried out by grafting a hydrophilic polymer to the dithioester functionalized phosphonatomethylaryl ligand.

14. The method according to claim 13, wherein the hydrophilic polymer is formed by polymerizing one or more hydrophilic monomers, the hydrophilic monomers being selected from the group consisting of methacrylamide, 2-acrylamido-2-methyl-1-propanesulfonic acid, 3-(acrylamido)phenylboronic acid, N-hydroxyethyl acrylamide, (4-hydroxyphenyl)methacrylamide, acrylic acid, 6-O-acryloyl-1,2:3,4-bis-O-(1-methylethylidene)-α-D-galactopyranose, poly(ethoxy (10) ethyl methacrylate), hydroxypoly (ethoxy (10) allyl ether), N, N-dimethylacrylamide, methacrylic acid, Beta-carboxyethyl acrylate, sodium 1-allyloxy-2 hydroxypropyl sulfonate, allyl phenyl ether, 2-cyanoethyl acrylate, ethylene glycol dimethacrylate, diallyl maleate and 4-vinylphenol and mixtures thereof.

15. The method according to claim 10, wherein the compound having the phosphonatomethylaryl moiety functionalized with a dithioester group is a compound having a structure selected from the group consisting of:

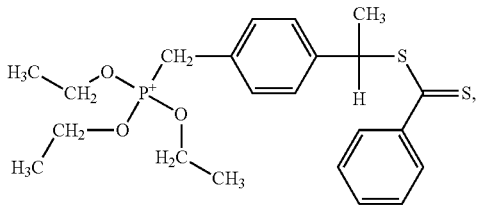

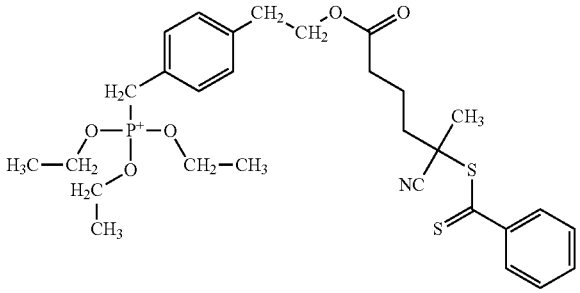

and mixtures thereof.

16. The method according to claim 10, wherein a degree of polymerization of the hydrophilic polymer group is from about 2 to about 2,000.

17. A modified metal oxide particle having an outer surface and hygroscopic polymer attached to the surface, the modified metal oxide particle made by the method comprising:

mixing a metal oxide particle having an outer surface with a compound having a phosphonatomethylaryl moiety functionalized with a dithioester group, wherein the phosphonatomethylaryl moiety attaches to the outer surface to form a dithioester functionalized phosphonatomethylaryl ligand; and linking a hydrophilic polymer group to the metal oxide particle using the dithiofunctionalized phosphonatomethylaryl ligand as a linking group to form the hygroscopic polymer.

18. The modified metal oxide particle according to claim 17, wherein the compound having the phosphonatomethylaryl moiety functionalized with a dithioester group is a compound having a structure selected from the group consisting of:

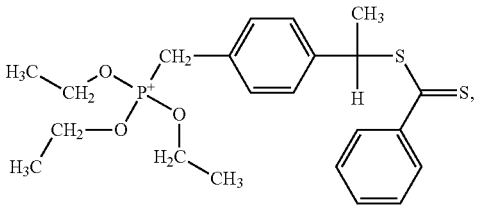

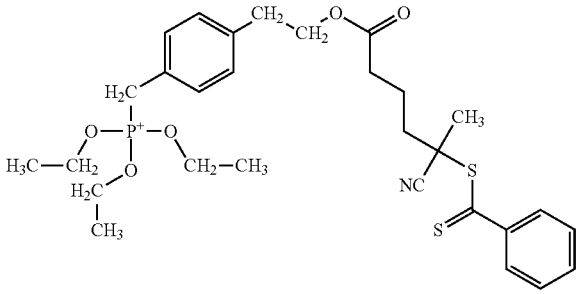

and mixtures thereof.

19. The modified metal oxide particle according to claim 17, wherein the hydrophilic polymer group is formed by polymerizing one or more hydrophilic monomers, the hydrophilic monomers being selected from the group consisting of methacrylamide, 2-acrylamido-2-methyl-1-propanesulfonic acid, 3-(acrylamido)phenylboronic acid, N-hydroxyethyl acrylamide, (4-hydroxyphenyl)methacrylamide, acrylic acid, 6-O-acryloyl-1,2:3,4-bis-O-(1-methylethylidene)-α-D-galactopyranose, poly(ethoxy (10) ethyl methacrylate), hydroxypoly(ethoxy (10) allyl ether), N, N-dimethylacrylamide, methacrylic acid, Beta-carboxyethyl acrylate, sodium 1-allyloxy-2 hydroxypropyl sulfonate, allyl phenyl ether, 2-cyanoethyl acrylate, ethylene glycol dimethacrylate, diallyl maleate and 4-vinylphenol and mixtures thereof.

20. The modified metal oxide particle according to claim 17, wherein a degree of polymerization of the hydrophilic polymer group is from about 2 to about 2,000.

* * * * *